US007538275B2

(12) United States Patent
Konnik et al.

(10) Patent No.: US 7,538,275 B2
(45) Date of Patent: May 26, 2009

(54) FIRE RESISTANT CABLE

(75) Inventors: Robert Konnik, South Windsor, CT (US); Michael Mennone, Guilford, CT (US)

(73) Assignee: Rockbestos Surprenant Cable Corp., East Granby, CT (US)

( * ) Notice: Subject to any disclaimer, the term of this patent is extended or adjusted under 35 U.S.C. 154(b) by 0 days.

(21) Appl. No.: 11/052,182

(22) Filed: Feb. 7, 2005

(65) Prior Publication Data

US 2006/0175075 A1 Aug. 10, 2006

(51) Int. Cl.
*H01B 3/30* (2006.01)

(52) U.S. Cl. ..... 174/110 R; 174/113 R; 174/120 R; 174/120 AR

(58) Field of Classification Search ..... 174/121 A, 174/11 OR, 110 R, 110 AR, 110 N, 110 D, 174/110 FC, 110 S, 113 R, 116, 120 R, 120 AR, 174/121 R, 121 AR, 122 R, 122 G, 122 C
See application file for complete search history.

(56) References Cited

U.S. PATENT DOCUMENTS

| | | | | |
|---|---|---|---|---|
| 1,651,590 | A | 12/1927 | Fisher et al. | |
| 2,800,524 | A * | 7/1957 | Lear | 174/116 |
| 3,238,025 | A * | 3/1966 | Cornell et al. | 428/662 |
| 3,576,940 | A | 5/1971 | Stone et al. | 174/113 R |
| 4,214,693 | A | 7/1980 | Smith | 228/148 |
| 5,036,121 | A | 7/1991 | Coaker et al. | 524/100 |
| 5,183,079 | A * | 2/1993 | Blin | 138/110 |
| 5,227,586 | A * | 7/1993 | Beauchamp | 174/122 R |
| 5,296,260 | A | 3/1994 | Sawada et al. | 427/118 |
| 5,705,774 | A * | 1/1998 | Beauchamp | 174/121 R |
| 5,980,695 | A | 11/1999 | Cox et al. | 202/166 |
| 6,048,196 | A | 4/2000 | Collier et al. | 431/264 |
| 6,220,821 | B1 | 4/2001 | Kern et al. | 417/48 |
| 6,387,518 | B1 * | 5/2002 | Wolfer et al. | 428/447 |
| 6,407,339 | B1 | 6/2002 | Rice et al. | 174/110 SR |
| 6,581,684 | B2 | 6/2003 | Wellington et al. | 166/245 |
| 6,591,906 | B2 | 7/2003 | Wellington et al. | 166/250.01 |
| 2002/0153241 | A1 | 10/2002 | Niv et al. | 204/164 |
| 2003/0055157 | A1 * | 3/2003 | Wolfer et al. | 524/588 |
| 2004/0031424 | A1 | 2/2004 | Pope | 110/230 |
| 2004/0118591 | A1 | 6/2004 | Bufanda et al. | 174/106 R |
| 2004/0139752 | A1 | 7/2004 | Pye et al. | 62/45.1 |
| 2004/0211557 | A1 | 10/2004 | Cole et al. | 166/242.1 |

FOREIGN PATENT DOCUMENTS

| | | |
|---|---|---|
| DE | 197 17 645 A1 * | 10/1998 |
| JP | 11066974 | 3/1999 |
| WO | WO 02/35666 | 2/2002 |

OTHER PUBLICATIONS

Cooperative Research Centre for Polymers *Annual Report*, 2003-2004.

Underwriters Laboratories Inc., *UL Standard "Safety for Rapid Rise Fire Tests of Protection Materials for Structural Steel", UL 1709*, Second Edition, reprinted May 21, 1998.

* cited by examiner

*Primary Examiner*—William H Mayo, III
(74) *Attorney, Agent, or Firm*—Hayes Soloway P.C.

(57) ABSTRACT

A fire resistant electrical cable includes a conductor. Substantially applied around the conductor is an inorganic braid. A ceramifiable polymer is substantially applied over the jacket. The fire resistant electrical cable also includes a retaining jacket substantially applied over the ceramifiable polymer. Multiple fire resistant electrical cables may be combined within a single grouping jacket to provide multi-phase conductance.

9 Claims, 4 Drawing Sheets

FIRE RESISTANT CABLE

FIELD OF THE INVENTION

The present invention is in the field of electrical cable. More specifically, the present invention is in the field of fire resistant electrical cable.

BACKGROUND OF THE INVENTION

The availability of electrical devices during fires can have lifesaving implications. Exit signs and emergency lights guide where to go in an emergency. Hard-wired fire alarms alert people to an emergency situation. In hospitals and nursing homes, electricity is needed to power devices that are directly in use to sustain life. For a petroleum or chemical plant, operations of emergency electrically operated shutoff valves in a fire are critical to allowing safe shutdown of a plant before a fire can have catastrophic effects.

Presently, most electrical wires are at risk in a fire-related emergency. Most wiring is not designed to sustain operation at high temperatures experienced in a fire. Even more wiring is ill prepared to sustain operation in a fast-rising temperature environment, such as environments where the temperature increases by hundreds of degrees each minute. During a fire-related emergency, this wiring is prone to failure.

Some wiring is designed to survive for up to two hours when exposed to a flame at up to 1850 degrees Fahrenheit. This wire is commercially available for NFPA 70 (Natiional Electrical Code) applications such as Article 695 for Fire Pumps and Article 700 for emergency systems. The temperature profile used for these applications is per ASTM E 119, which slowly raises the temperature to 1000° F. at 5 minutes to 1700° F. at 1 hour and 1850° F. at 2 hours. A test method to monitor cable circuit integrity with the ASTM E 119 temperature profile is in Underwriters Laboratories (UL) 2196. However, this same wiring will typically fail within ten minutes in a fast-rising temperature scenario, even if that temperature never rises above 2000 degrees Fahrenheit. Part of the reason for this disparity is that these cables can have a copper sheath or armor, that will melt, as well as a copper conductor. Another reason for the disparity is that a fast-rising temperature environment exposes wiring to significant thermal heat flux, sometimes exceeding 50,000 BTU/sq.ft.-hr. Most wiring is not designed to survive a fast-rising temperature environment.

For a chemical or petrochemical application, many flammable liquids may be present. These flammable liquids are the reason for the fast rise temperature profile, which simulates a hydrocarbon pool fire. The temperature profile is from UL 1709 and ASTM E 1529 that specifies a rapid rise temperature of ambient temperature to 2000° F. within 5 minutes, and holding at 2000° F. for the duration of the test. American Petroleum Institute publication 2218 "Fireproofing Practices in Petroleum and Petrochemical Processing Plants" section 6.1.8.1 states that electrical, instrumentation, and control systems used to activate equipment needed to control a fire or mitigate its consequences (such as emergency shut down systems) should be protected from fire damage for 15 to 30 minutes of fire exposure functionally equivalent to the conditions of UL 1709. The procedure in UL 1709/ASTM E 1529 specifies a totally enclosed chamber with a specified heat flux of 65,000 BTU/sq.ft.-hr and 50,000 BTU/sq.ft.-hr respectively. Since the test method in UL 1709/ASTM E 1529 is for structural steel, the circuit integrity method in UL 2196 is used to monitor cable operability.

There are other test methods that can simulate the temperature profile of UL 1709, but are not enclosed. One such method is IEC 60331-11 (formerly 331) which has an open flame. The flame temperature can be 2000° F., but because of convection, radiation, and conductance, one point on the test sample may be 2000° F., but the other side can be many hundreds of degrees lower. Another test method is MIL-DTL-25038 (formerly MIL-W-25038), which has a shake and bake test at 2000° F., which is similarly not enclosed. Cables that may pass these test tests will typically fail within 10 minutes in the UL 1709 test method.

One type of wiring that is designed to survive a fast-rising temperature is stainless steel mineral insulated (MI) cable with nickel conductor. MI cable, as the name implies, has compacted minerals located between a solid conductor and a solid metal tube outer layer. The solid conductor, as well as the mineral insulation, and metal tube make MI cable difficult to handle. Also, due to the mineral insulation, very special tools are required to terminate the MI cable connection. This MI cable is not available in long lengths, and has a very high electrical resistance due to the nickel conductor. This increased resistance requires an increase in conductor size, which limits lengths further, and makes the MI cable costlier and even harder to handle. The solid conductor is susceptible to breakage due to fatigue of the metal when it is repeatedly bent as is required for value maintenance. Finally, MI cable is susceptible to failure during exposure to moisture or water and any susceptibility to failure is undesirable in emergency power cables.

Thus, a heretofore unaddressed need exists in the industry to address the aforementioned deficiencies and inadequacies.

SUMMARY OF THE INVENTION

Embodiments of the present invention provide a system and method for using a fire resistant cable. Briefly described in architecture, one embodiment of the system, among others, can be implemented as follows. The fire resistant electrical cable includes a conductor. Substantially applied around the conductor is an inorganic braid. A ceramifiable polymer is substantially applied over the braid.

In another aspect, the invention features a method for using a fire resistant cable. The method includes the steps of: connecting the cable to a power source, wherein the cable includes: a conductor, an inorganic braid substantially applied over the conductor, and a ceramifiable polymer substantially applied over the braid; connecting at least one conductor to a load, wherein at least a portion of the conductor is within an environment; conducting a current through the cable; increasing a temperature of the environment from a temperature approximately below 200 degrees Fahrenheit to a temperature at least approximately 2000 degrees Fahrenheit.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
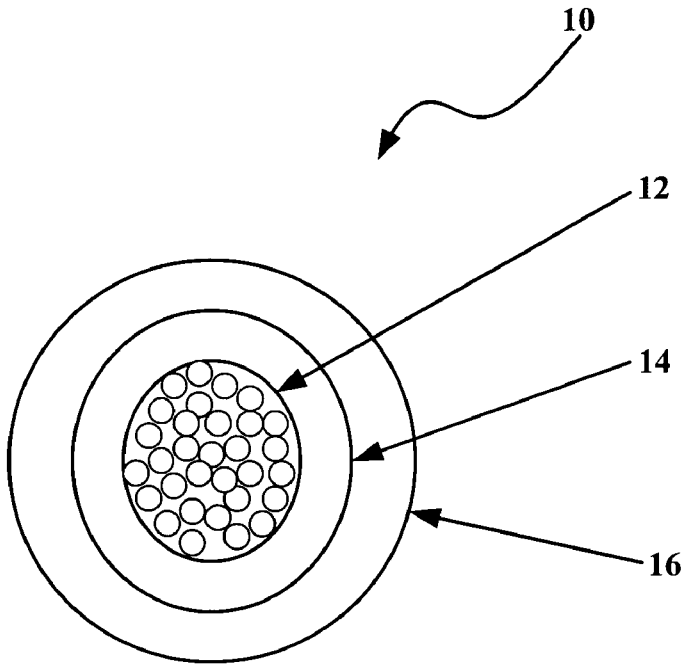
FIG. 1 is a cross-sectional drawing of a fire resistant electrical cable, according to a first exemplary embodiment of the invention.

FIG. 1 is a cross-sectional drawing of a fire resistant electrical cable 10, according to a first exemplary embodiment of the invention. The fire resistant electrical cable 10 includes a conductor 12. Substantially applied around the conductor 12 is an inorganic braid 14. A ceramifiable polymer 16 is substantially applied over the braid 14.

The conductor 12 can be constructed in a variety of ways. The conductor 12 may be a single solid wire or it may be multiple wires bundled together. As is known to those having ordinary skill in the art, multiple stranded wires bundled together are easier to twist than a single, solid wire. The conductor 12 may include one or more nickel-coated copper wires. The conductor 12 may, as an example, include a 27% nickel conductor with oxygen-free high-conductivity copper, or it may be solid copper, solid nickel, or another similar conductive material. The preferred characteristics of the conductor 12 are that it is electrically conductive and that it maintains integrity at high temperatures, such as at 2000 degrees Fahrenheit.

The inorganic braid 14 includes a number of possible materials. The inorganic braid 14, may be, for instance, a ceramic braid, a ceramic tape (possibly woven), or a high-temperature glass braid or tape. The inorganic braid 14 has a number of useful qualities. The inorganic braid 14 may be heat resistant and thermally insulative to protect the conductor 12. The inorganic braid 14, when combined with the ceramifiable polymer 16, may retain air pockets (air pockets not shown). Air is an excellent thermal insulator and the air pockets will help to thermally insulate the conductor 12. Also, as explained further herein, when heated, the ceramifiable polymer 16 will expand. As the ceramifiable polymer 16 expands, the inorganic braid 14 will expand with the ceramifiable polymer 16, which works to protect the integrity of the ceramifiable polymer 16, limiting cracking. The ceramifiable polymer 16 loses some mass when it ceramifies, and the air pockets help insulate the conductor 12 from the external heat.

The ceramifiable polymer 16 may be one of many such polymers known to those having ordinary skill in the art. For example, the ceramifiable polymer 16 may be the polymer described in U.S. Pat. No. 6,387,518. The ceramifiable polymer 16 may be a ceramifiable silicone rubber. One characteristic of the ceramifiable polymer 16 is that it ceramifies under heat. The ceramifiable polymer 16, for instance, may begin to ceramify at a temperature of approximately between 600 degrees Fahrenheit and 900 degrees Fahrenheit. The ceramifiable polymer 16 may, for instance, begin to ceramify at a temperature below 950 degrees Fahrenheit. As the ceramifiable polymer 16 ceramifies, it changes from a flexible rubber-like material to a more solid, ceramic-like material. As the ceramifiable polymer 16 ceramifies, it may expand. If the ceramifiable polymer 16 is heated too rapidly to significant temperatures, the ceramifiable polymer 16 may expand too quickly, causing it to crack and otherwise degrade its integrity. The braid 14 acts as a buffer between the conductor 12 and the ceramifiable polymer 16, allowing differential expansion and minimizing cracking. The stranded wire conductor 12, inorganic braid 14, and ceramifiable polymer 16 allow the fire resistant electrical cable 10 to be manipulated more easily than MI cables.

Figure 2:
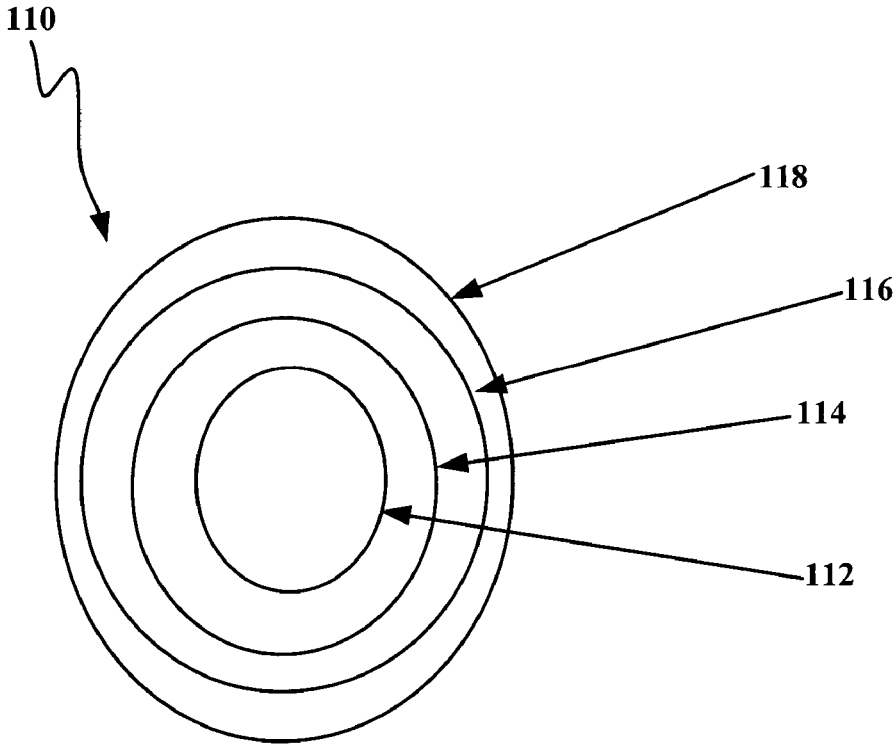
FIG. 2 is a cross-sectional drawing of a fire resistant electrical cable, according to a second exemplary embodiment of the invention.

FIG. 2 is a cross-sectional drawing of a fire resistant electrical cable 110, according to a second exemplary embodiment of the invention. The fire resistant electrical cable 110 includes a conductor 112. Substantially applied around the conductor 112 is an inorganic braid 114. A ceramifiable polymer 116 is substantially applied over the inorganic braid 114. The fire resistant electrical cable 110 also includes a retaining jacket 118 substantially applied over the ceramifiable polymer 116.

The retaining jacket 118 may be provided to protect the integrity of the ceramifiable polymer 116. If the ceramifiable polymer 116 is heated too rapidly to significant temperatures, the ceramifiable polymer 116 may expand too quickly, causing it to crack and otherwise degrade its integrity. The retaining jacket 118 may be provided to restrain or inhibit the expansion of the ceramifiable polymer 116. By inhibiting the expansion of the ceramifiable polymer 116, the retaining jacket 118 reduces the chances of the ceramifiable polymer 116 degrading its integrity by expanding. The retaining jacket 118 may be, for example, something as simple as non-flammable tape.

The retaining jacket 118 may also have other characteristics that contribute to the characteristics of the fire resistant electrical cable 110. The retaining jacket 118 may, for instance, be an electrically insulative polymer. The retaining jacket 118 may, for instance, be a thermally insulative polymer. The retaining jacket 118 may be heat resistant such that an integrity of the retaining jacket is maintained up to at least 900 degrees Fahrenheit.

Figure 3:
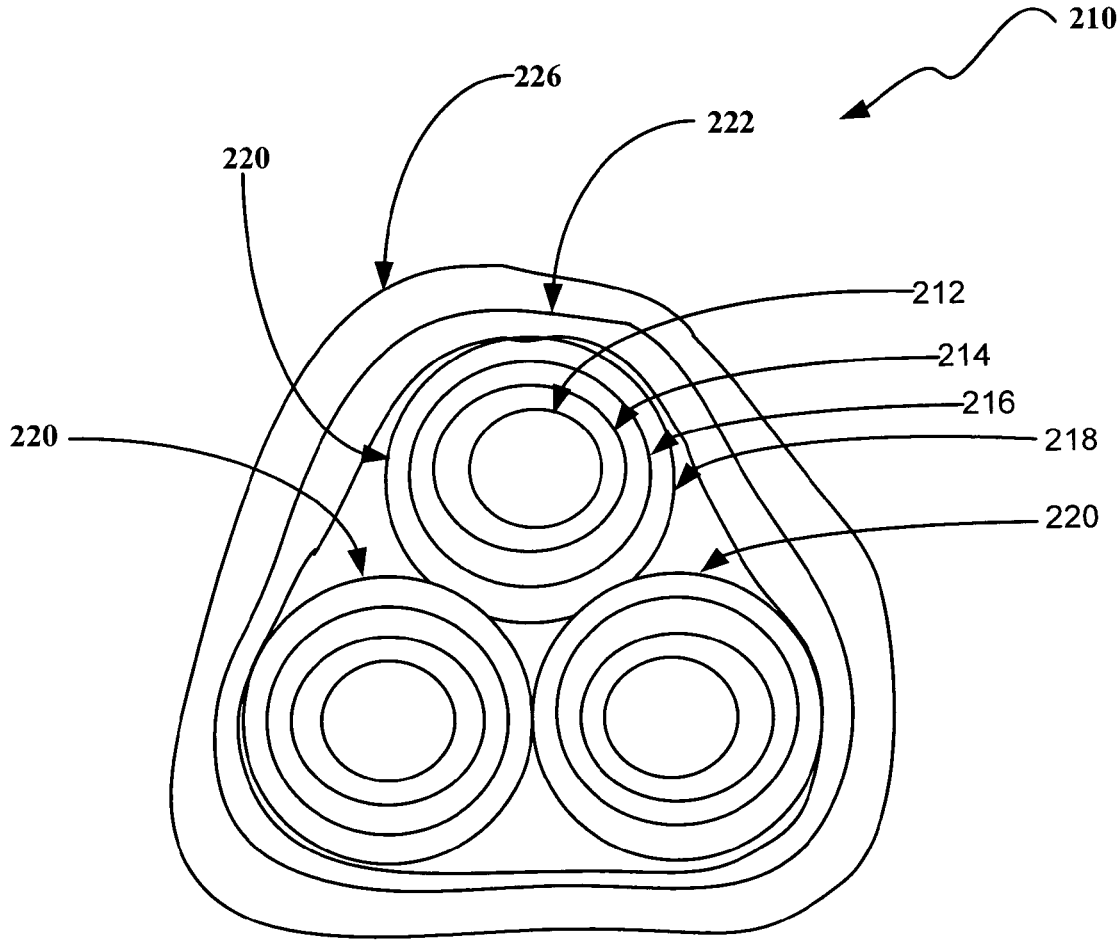
FIG. 3 is a cross-sectional drawing of a fire resistant electrical cable, according to a third exemplary embodiment of the invention.

FIG. 3 is a cross-sectional drawing of a fire resistant electrical cable 210, according to a third exemplary embodiment of the invention. The fire resistant electrical cable 210 is a multiple conductor cable, shown in FIG. 3 having three individual cables 220, although more or less individual cables may be provided. Each of the individual cables 220 includes a conductor 212. Substantially applied around each conductor 212 is an inorganic braid 214. A ceramifiable polymer 216 is substantially applied over each inorganic braid 214. A grouping jacket 222 is applied around the bundle of individual cables 220.

The grouping jacket 222 may be used to keep the bundle of individual cables 220 together. Another braid, for example, may be used for the purpose of a grouping jacket 222. Binder tape, which is common to the industry for retaining multiple cables, may be used as the grouping jacket 222. A fire-insulating jacket 226 may be applied around the grouping jacket 222 to further protect the individual cables 220 from fire-related harm and/or from mechanical damage that may occur during installation.

A retaining jacket 218 may be provided, substantially applied over each ceramifiable polymer 216. While the grouping jacket 222 may work to inhibit some of the expansion of the ceramifiable polymer 216, the expansion of which was previously discussed herein, a retaining jacket 218 may provide more effective limitations on that expansion.

Figure 4:
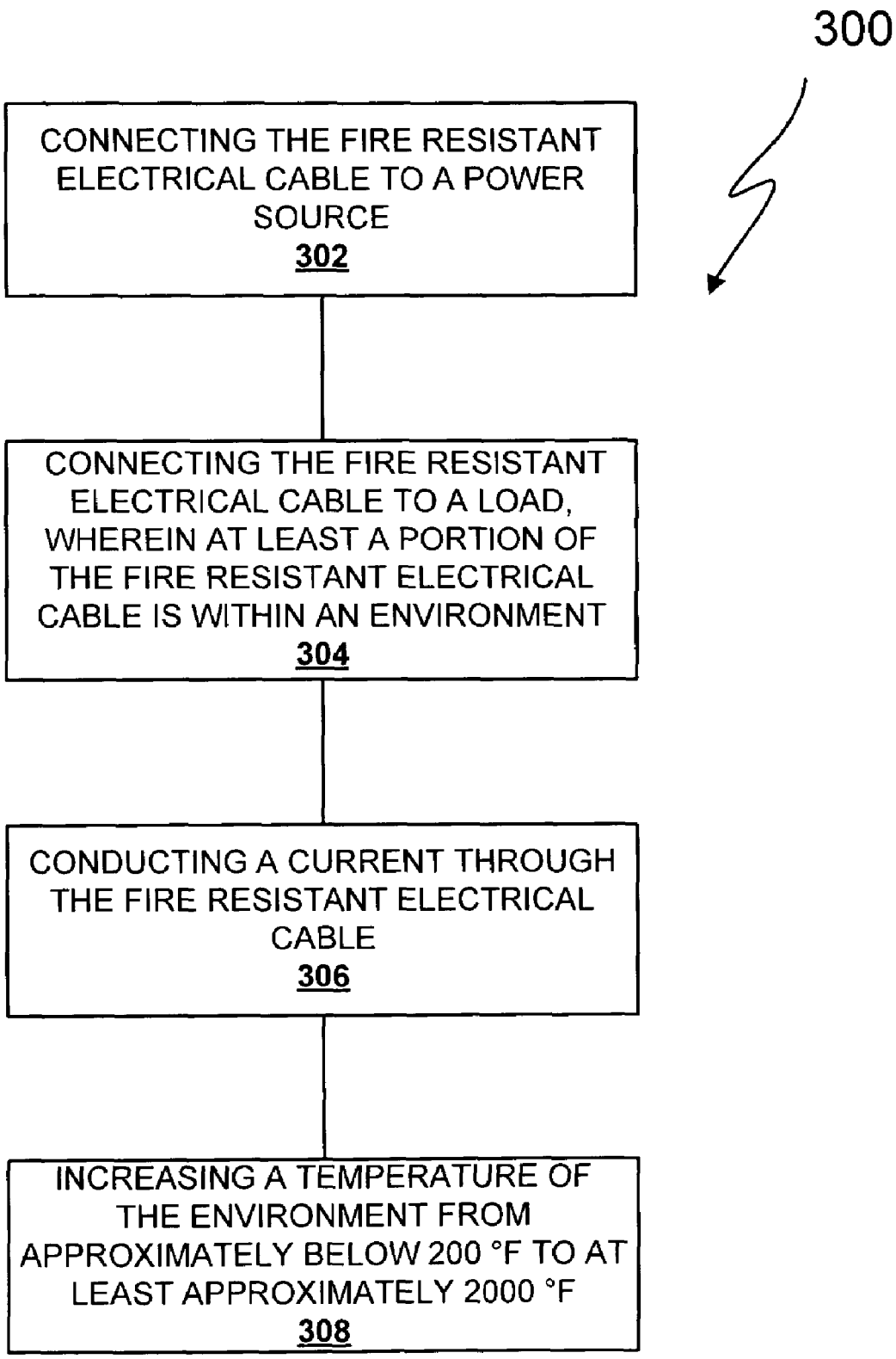
FIG. 4 is a flow chart illustrating a possible implementation of the invention shown in FIG. 2, in accordance with the second exemplary embodiment of the invention.

The flow chart of FIG. 4 shows the functionality and operation of a possible implementation of a method for using the fire resistant electrical cable 110, in accordance with the second exemplary embodiment shown in FIG. 2. In this regard, each block represents a module, segment, or step, which comprises one or more instructions for implementing the specified function. It should also be noted that in some alternative implementations, the functions noted in the blocks might occur out of the order noted in FIG. 4. For example, two blocks shown in succession in FIG. 4 may in fact be executed non-consecutively, substantially concurrently, or the blocks may sometimes be executed in the reverse order, depending upon the functionality involved, as will be further clarified herein.

Figure 5:
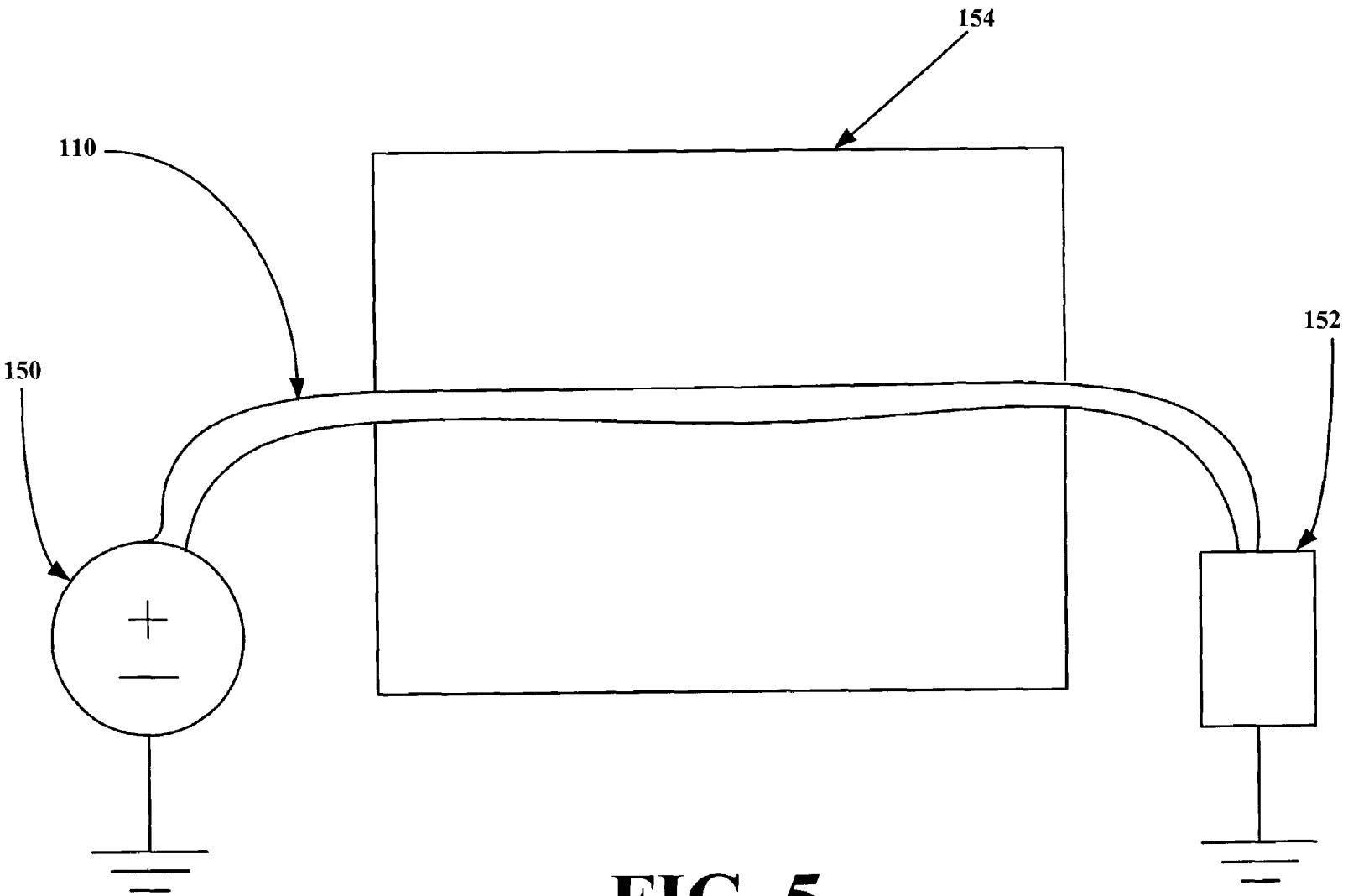
FIG. 5 is a diagram showing an exemplary use of the fire resistant electrical cable, as illustrated in FIG. 4, in accordance with the second exemplary embodiment of the invention.

FIG. 4 is a flow chart illustrating a possible method 300 of implementation of the invention shown in FIG. 5, in accordance with the second exemplary embodiment of the invention. FIG. 5 is a diagram showing an exemplary use of the fire resistant electrical cable 110, in accordance with the second exemplary embodiment of the invention. The method 300 of using a fire resistant electrical cable 110 includes connecting the fire resistant electrical cable 110 to a power source 150 (block 302). The fire resistant electrical cable 110 includes a conductor 112, an inorganic braid 114 substantially applied over the conductor 112, and a ceramifiable polymer 116 substantially applied over the inorganic braid 114, as was shown in FIG. 2. The fire resistant electrical cable 110 is also connected to a load 152 and at least a portion of the fire resistant electrical cable 110 is within an environment 154 (block 304). A current is conducted through the fire resistant electrical cable 110 (block 306). A temperature of the environment 154 is increased from a temperature of approximately below 200 degrees Fahrenheit to a temperature of at least approximately 2000 degrees Fahrenheit (block 308).

One of the purposes contemplated for the fire resistant electrical cable 110 is continued operation during exposure to significant high temperatures. The fire resistant electrical cable 110 disclosed herein has shown the capacity to continue conducting a current for at least one hour while the temperature of the environment 154 is approximately 2000 degrees Fahrenheit. Another purpose contemplated for the fire resistant electrical cable 110 is continued operation during and after exposure to rapid temperature rises. The fire resistant electrical cable 110 disclosed herein has demonstrated the capacity to continue conducting a current after increasing the temperature within the environment 154 from ambient temperature to 2000 degrees Fahrenheit in a time span of approximately five minutes. For testing purposes, ambient temperature was made to be between 50 degrees Fahrenheit and 90 degrees Fahrenheit. This type of controlled environment 154 testing is designed to demonstrate the ability of the fire resistant electrical cable 110 to maintain operation in an actual rapid-temperature-rise fire situation.

It should be emphasized that the above-described embodiments of the present invention are merely possible examples of implementations, simply set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

We claim:

1. A fire resistant electrical cable comprising:

a conductor;

an inorganic braid substantially applied over the conductor;

a ceramifiable silicon rubber substantially applied over the inorganic braid; and a nonmetallic retaining jacket substantially applied over the inorganic braid.

2. The cable of claim 1 wherein the conductor comprises at least one nickel coated copper wire.

3. The cable of claim 1 wherein the inorganic braid further comprises a beat resistant braid.

4. The cable of claim 1, further comprising air pockets formed with the inorganic braid and enclosed by the ceramifiable silicon rubber.

5. The cable of claim 1 wherein the ceramifiable silicon rubber will begin to ceramify at a temperature between 550 degrees Fahrenheit and 950 degrees Fahrenheit.

6. The cable of claim 1 wherein the retaining jacket further comprises an electrically insulative polymer.

7. The cable of claim 1 wherein the retaining jacket is heat resistant such that integrity of the retaining jacket is maintained up to 900 degrees Fahrenheit.

8. The cable of claim 1 wherein the conductor is electrically conductive and has a melting point of approximately at least 2000 degrees Fahrenheit.

9. The cable of claim 1 wherein the conductor further comprises oxygen-free high-conductivity copper.

* * * * *

UNITED STATES PATENT AND TRADEMARK OFFICE

CERTIFICATE OF CORRECTION

PATENT NO. : 7,538,275 B2
APPLICATION NO. : 11/052182
DATED : May 26, 2009
INVENTOR(S) : Konnik et al.

It is certified that error appears in the above-identified patent and that said Letters Patent is hereby corrected as shown below:

Col. 6, Claim 3, Line 30, “beat” should be --heat--

Signed and Sealed this

Thirtieth Day of June, 2009

JOHN DOLL
*Acting Director of the United States Patent and Trademark Office*